US010381189B2

(12) United States Patent
Jeong et al.

(10) Patent No.: US 10,381,189 B2
(45) Date of Patent: Aug. 13, 2019

(54) X-RAY TUBE

(71) Applicant: ELECTRONICS AND TELECOMMUNICATIONS RESEARCH INSTITUTE, Daejeon (KR)

(72) Inventors: Jin-Woo Jeong, Daejeon (KR); Yoon-Ho Song, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 221 days.

(21) Appl. No.: 15/414,455

(22) Filed: Jan. 24, 2017

(65) Prior Publication Data

US 2017/0213687 A1 Jul. 27, 2017

(30) Foreign Application Priority Data

Jan. 26, 2016 (KR) ..... 10-2016-0009297
Jul. 13, 2016 (KR) ..... 10-2016-0088781

(51) Int. Cl.
*H01J 35/14* (2006.01)
*H01J 35/04* (2006.01)
*G21K 1/02* (2006.01)

(52) U.S. Cl.
CPC ..... *H01J 35/04* (2013.01); *G21K 1/02* (2013.01)

(58) Field of Classification Search
CPC .. H01J 35/14; G21K 1/10; G21K 1/02; G21K 1/025; A61B 6/40; A61B 6/44; A61B 6/4035
USPC ..... 378/119, 121, 122, 138, 156
See application file for complete search history.

(56) References Cited

U.S. PATENT DOCUMENTS 4,433,431 A * 2/1984 Pfeiler ..... H01J 35/10 378/124
4,730,353 A * 3/1988 Ono ..... H01J 35/06 378/113
2013/0336459 A1 12/2013 Choi et al.
2013/0336461 A1 12/2013 Jeong et al.

FOREIGN PATENT DOCUMENTS

KR 10-0948649 B1 3/2010
KR 10-2015-0026730 A 3/2015

* cited by examiner

*Primary Examiner* — Jurie Yun

(57) ABSTRACT

The present disclosure relates to an X-ray tube, and more particularly, to an X-ray tube having a simple structure from which an element necessary for focusing an electron beam, such as a magnetic lens, and having generating an X-ray having a focal spot of a nanometer-scale. The present disclosure includes: a electron beam generation unit emitting an electron beam; a limiting electrode unit limiting the electron beam emitted from the electron beam generation unit; and a target unit including a target material emitting an X-ray when the limited electron beam collides with the target material, wherein the limiting electrode includes of an electron beam limiting electrode allowing a portion of the emitted electron beam to pass therethrough and to be delivered to the target unit.

13 Claims, 4 Drawing Sheets

X-RAY TUBE

CROSS-REFERENCE TO RELATED APPLICATION

This U.S. non-provisional patent application claims priority under 35 U.S.C. § 119 of Korean Patent Application Nos. 10-2016-0009297, filed on Jan. 26, 2016, and 10-2016-0088781, filed on Jul. 13, 2016, the entire contents of which are hereby incorporated by reference.

BACKGROUND

The present disclosure relates to an X-ray tube, and more particularly, to an X-ray tube generating an X-ray, having a simple structure from which a element necessary for focusing an electron beam, such as a magnetic lens, is removed, and having a nanometer-scale focal spot.

An X-ray source (a nano focus X-ray source) having a nanometer-scale focal spot is required for a non-destructive inspection of an object having a microstructure, such as a semiconductor chip.

In general, a nano focus X-ray source includes an electron source (cathode) generating an electron beam, a focusing unit focusing the electron beam emitted from the electron source, and a target (anode) enabling the focused electron beam to collide with each other to generate an X-ray. Herein, since the electron beam travels inside the X-rays source which is in a vacuum state, a proper vacuum is maintained in a path from the X-rays source to the target by a vacuum container.

The focusing unit is composed of a lens for focusing an electron beam, etc. Since an electrostatic lens has a limitation in demagnification due to an aberration etc., a magnetic lens having one or more stages for high focusing of electron beams is used to focus the electron beam in a nano meter size. The focused electron beam collides with a target of metal material and generates a nano focus X-ray.

In general, a magnetic lens is bulky and heavy, and continuously consumes current in order to form a magnetic field. Thus, the related arts of using the magnetic lens as a focusing unit have a limitation in that an X-ray source has a bulky and heavy shape due to the magnetic lens.

SUMMARY

The present disclosure provides an X-ray tube having a simple structure from which an element required for focusing an electron beam, such as a lens is removed, and generating a nano focus X-ray.

An embodiment of the inventive concept provides an X-ray tube including an electron beam generation unit emitting an electron beam, a limiting electrode unit limiting the electron beam emitted from the electron beam generation unit, and a target unit including a target material emitting an X-ray when the limited electron beam collides with the target material, wherein the limiting electrode unit includes an electron beam limiting electrode allowing a portion of the emitted electron beam to pass therethrough and to be delivered to the target unit.

In an embodiment, the target unit may emit an X-ray having a focal spot corresponding to the size of the portion of the electron beam delivered to the target unit by the limiting electrode unit.

In an embodiment, the limiting electrode unit may include a penetration type electron beam limiting electrode having a limiting opening having a predetermined diameter.

In an embodiment, the penetration type electron beam limiting electrode may deliver, to the target unit, a portion of the electron beam having passed the limiting opening among the emitted electron beams.

In an embodiment, the penetration type electron beam limiting electrode may be configured to have an equal electric potential as the target unit.

In an embodiment, the limiting electrode unit may include at least one slit type electron beam limiting electrode having a slit having a predetermined width.

In an embodiment, the at least one slit type electron beam limiting electrode may include at least one spacer having the thickness corresponding to the predetermined width, and a plurality of metal electrodes spaced by the at least one spacer.

In an embodiment, the at least one slit type electron beam limiting electrode may be disposed such that the slits are aligned with each other at a predetermined angle.

In an embodiment, the at least one slit type electron beam limiting electrode may have a matrix shape in which the slits are provided in a plurality of columns and rows.

In an embodiment, the slit may have an incident surface into which the emitted electron beam is incident and an emitting surface through which the portion of the electron beam is delivered to the target unit, and a width of the incident surface is greater than a width of the emitting surface.

In an embodiment, the limiting electrode unit may include at least one electron beam limiting electrode made of at least one of tungsten, molybdenum or gold.

In an embodiment, the X-ray tube may further include an electrostatic polarizer disposed between the electron beam generation unit and the limiting electrode unit, and controlling an incident location of the emitted electron beam with respect to the limiting electrode.

In an embodiment, the X-ray tube may further include a filter disposed between the target unit and an object to which the X-ray is delivered, and removing a low energy X-ray.

In an embodiment, the filter may be integrally provided with the target unit.

In an embodiment, the X-ray tube may further include a donut-shaped electrode disposed between the electron beam generation unit and the limiting electrode, and preventing retrogression of an X-ray by a remaining electron beam limited by the limiting electrode unit.

In an embodiment, the electron beam generation unit may include a cathode emitting the electron beam, and the target unit comprises an anode.

In an embodiment, the electron beam generation unit may further include a focusing unit focusing the emitted electron from the cathode in a micrometer-scale.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

In describing embodiments of the inventive concept, detailed descriptions related to well-known functions or configurations will be ruled out in order not to unnecessarily obscure subject matters of the inventive concept.

Herein, the term "comprise", "have", "may comprise" or "may have" intends to mean that there may be specified features, numerals, steps, operations, elements, parts, or combinations thereof, not excluding the possibility of the presence or addition of the specified features, numerals, steps, operations, elements, parts, or combinations thereof.

The term "include," "comprise," "may include," or "may comprise" used herein indicates disclosed functions, operations, or existence of elements but does not limit one or more additional functions, operations or elements. Also, it should be further understood that the terms "include," "comprise," or "have" used herein are intended to specify the presence of stated features, integers, steps, operations, elements, components, and/or combinations thereof described in the specification, but are not intended to pre-exclude the presence or addition of one or more other features, integers, steps, operations, elements, components, and/or combinations thereof.

Herein, a singular form, unless otherwise indicated in context, may include plural forms.

Hereinafter, example embodiments of the inventive concept will be described in detail with reference to the accompanying drawings.

Figure 1:
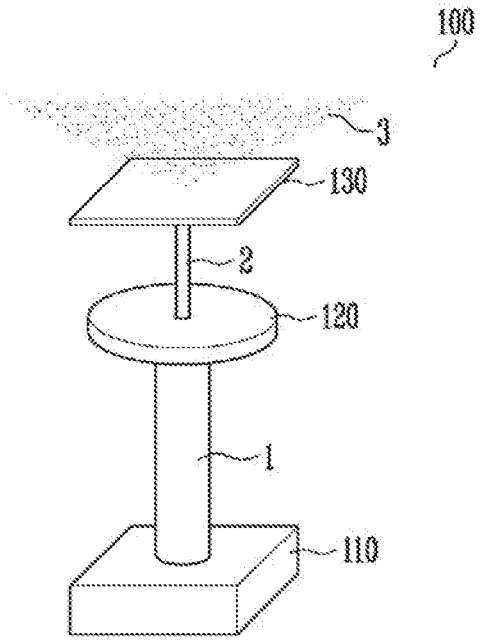
FIG. 1 (Prior Art)
FIG. 1 is a view showing a structure of a general X-ray tube.

FIG. 1 is a view showing a structure of a general X-ray tube.

Referring to FIG. 1, a general X-ray tube 100 is configured to include an electron source 110, a focusing unit 120 focusing electron beams emitted from the electron source 110, and a target unit 130 consisting of a target material emitting an X-ray by collision of the electron beams focused in the focusing unit 120 thereto.

The foregoing elements are installed in a vacuum container completely sealed or in which an internal vacuum state is maintained by a vacuum pump such that electron beams may be generated and accelerated in a vacuum environment. The vacuum container may be made of a ceramic or a glass material such as aluminum oxide, aluminum nitride or glass having excellent high voltage characteristics and suitable for a vacuum container.

In general, the electron source 110 is composed of a cathode and is connected to a negative terminal of a power source, and the target unit 130 is composed of an anode and is connected to a positive terminal of the power source. Electrons emitted from the cathode are accelerated from the cathode to the anode by a difference between a negative potential of the cathode and a positive potential of the anode to form an electron beam 1. The electrons arriving at the anode collides with a metal target of the anode to generate an X-ray 3. In various related arts, a gate for controlling the amount of the electron beam may be further provided between the anode and the cathode.

The focusing unit 120 includes at least one focusing lens to focus the electron beam 1 emitted from the electron source 110 in a required size. For example, the focusing unit 120 may include an electrostatic lens, a magnetic lens or the like.

In general, the electrostatic lens has a limitation in reducing the size thereof, and the magnetic lens also has disadvantages of being bulky and heavy and continuously consuming current.

In a non-destructive inspection of a fine structure of an object such as a semiconductor chip, it is required that the focusing unit 120 sufficiently focus the electron beam 1 in order to generate an X-ray (a nano focus X-ray) having a nanometer-scale focal spot. However, when a plurality of large sized focusing lenses are mounted in the focusing unit 120 for the foregoing purpose, the overall size of the X-ray tube 100 increases.

Hereinafter, an X-ray tube structure capable of generating a nano focus X-ray without a focusing lens is described as a technical feature of the inventive concept to solve the foregoing limitations.

In the followings embodiments, the present disclosure is characterized in that a focusing unit 120 is composed of an electron beam limiting electrode having a channel which allows only a portion of an electron beam 1 emitted from an electron source 110 to arrive at a target unit 130 and a remaining electron beam 1 to be blocked.

Figure 2:
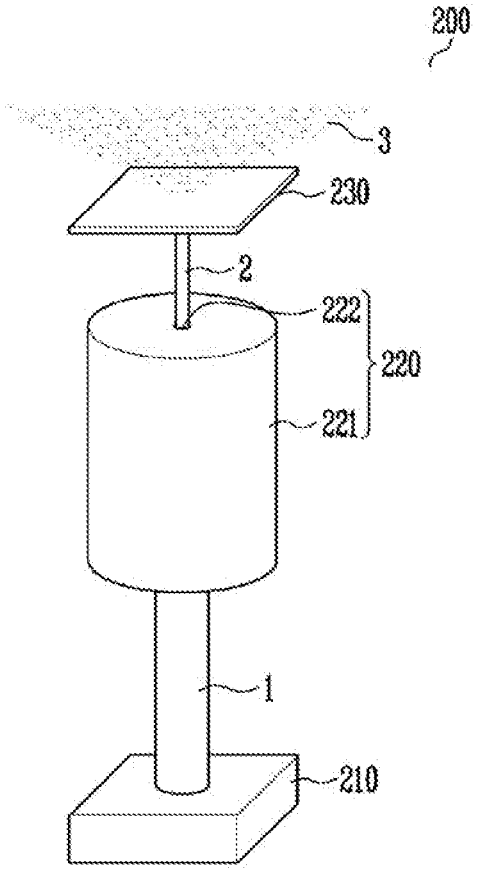
FIG. 2 is a view showing a structure of an X-ray tube according to embodiment 1 of the inventive concept.

FIG. 2 is a view showing a structure of an X-ray tube according to embodiment 1 of the inventive concept.

Referring to FIG. 2, an X-ray tube 200 according to embodiment 1 of the inventive concept includes an electron beam generation unit 210 emitting an electron beam, a limiting electrode unit 220 limiting the electron beam emitted from the electron beam generation unit 210, and a target unit 230 composed of a target material emitting an X-ray by collision with the electron beam having passed through the limiting electrode 220 and having a limited size.

The foregoing elements are installed in a vacuum container completely sealed or in which an internal vacuum state is continuously maintained by a vacuum pump such that electron beams may be generated and accelerated in a vacuum environment. The vacuum container may be made of a ceramic or a glass material, such as aluminum oxide, aluminum nitride or glass having excellent high voltage characteristics and suitable for a vacuum container.

The electron beam generation unit 210 is composed of a cathode connected to a negative terminal of a power source and emitting an electron in the form of an electron beam. Also, the electron beam generation unit 210 may include a focusing unit configured to focus the electron beam emitted from the cathode such that the electron beam has a constant size, for example a nanometer-scale size. A gate configured to control the amount of the electron beam may be further provided to the electron beam generation unit 210.

The target unit 230 is composed of an anode and is connected to a positive terminal of the power source. The electron beam generated from the electron beam generation unit 210 collides with a metal target of the anode to generate an X-ray.

In the X-ray tube generating a nano focus X-ray, since the current of an electron beam arriving at the target unit 230 is several to several tens of micro amperes (μA) which are not relatively high, it is possible to generate a nano focus X-ray by limiting the diameter of the focused electron beam such that the focused electron beam has a nanometer-scale diameter as well as a sufficiently high current density.

In embodiment 1 of the inventive concept, the limiting electrode unit 220 is composed of a penetration type electron beam limiting electrode 221 having a limiting opening 222 with a predetermined diameter. The diameter of the limiting opening 222 may be determined by the size of a focal spot of an X-ray to be generated in the X-ray tube 200. For example, the limiting opening 222 of embodiment 1 may have a nanometer-scale diameter, and in this case, the X-ray tube 200 may possibly generate a nano focus X-ray.

In embodiment 1 of the inventive concept, the electron beam 1 emitted from the electron beam generation unit 210 may have a micrometer-scale diameter. The electron beam 1 emitted from the electron beam generation unit 210 is delivered to the limiting electrode unit 220. In the limiting electrode unit 220, only a portion of electron beam 2 having passed the limiting opening 222 arrives at the target unit 230, and a remaining electron beam is limited by the penetration type electron beam limiting electrode 221 and thus is unable to arrive at the target unit 230. Herein, when the diameter of the limiting opening 222 is nanometer-scale, the electron beam 2 arriving at the target unit 230 will have the nanometer-scale diameter, and consequently, an X-ray 3 having a nanometer-scale focal spot may be emitted from the target unit 230 by collision of the electron beam 2.

When the electron beam limiting electrode 221 is a metal electrode type, the remaining electron beam limited by collision with the penetration type electron beam limiting electrode 221 may generate an unnecessary X-ray inside the X-ray tube 200. Thus, in various embodiments of the inventive concept, the penetration type electron beam limiting electrode 221 may be made of a material and with a thickness capable of shielding the X-ray generated by the limited rest electron beam. For example, the penetration type electron beam limiting electrode 221 may be made of a material having good shielding performance, such as tungsten, molybdenum or gold.

Further, in various embodiments of the inventive concept, the penetration type electron beam limiting electrode 221 may be configured to have the same electric potential as the electric potential of the target unit 230.

In order to produce the penetration type electron beam limiting electrode 221 according to embodiment 1 of the inventive concept, the limiting opening 222 having a predetermined diameter, such as a nanometer-scale diameter, should be precisely formed in a thick solid material capable of shielding an X-ray. Since the production process requires a high level of technology and a high accuracy, production efficiency may be lowered.

Hereinafter, a nano focus X-ray structure according to another embodiment of the inventive concept to solve the limitation in production will be described.

Figure 3:
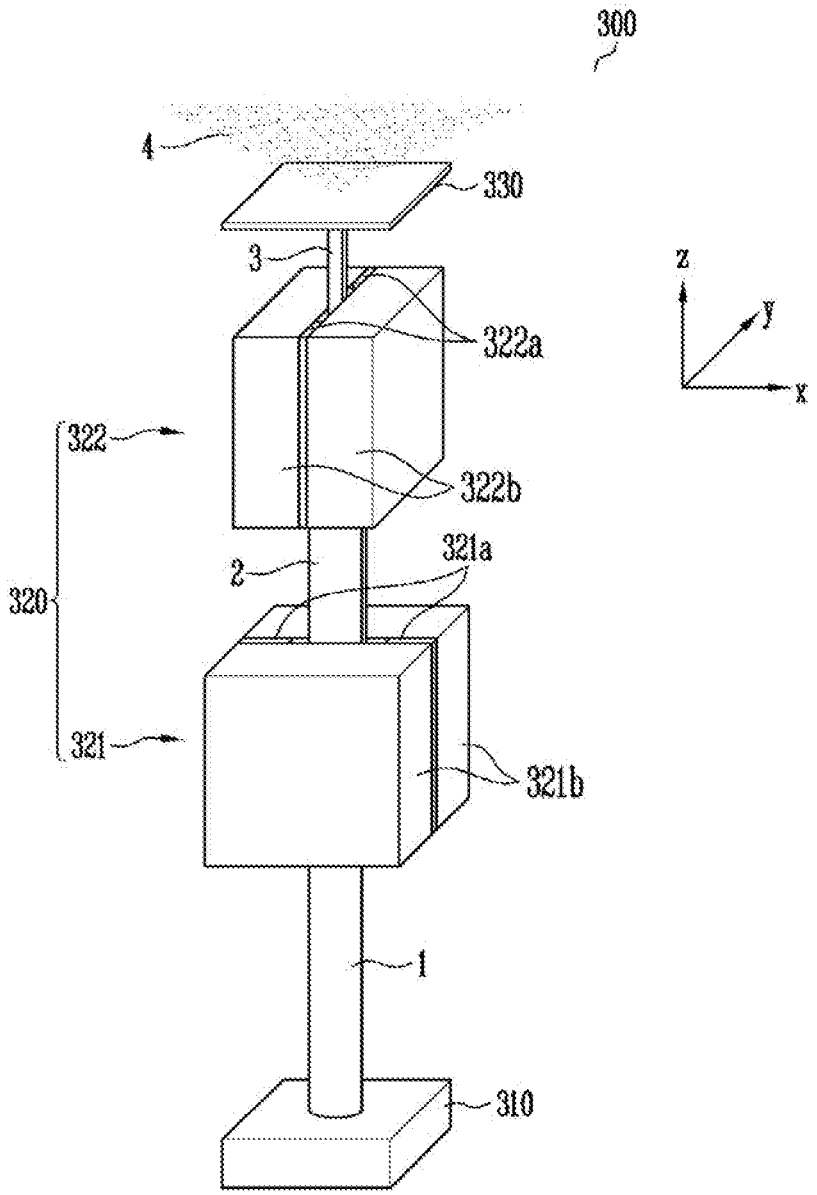
FIG. 3 is a view showing a structure of an X-ray tube according to embodiment 2 of the inventive concept.

FIG. 3 is a view showing a structure of an X-ray tube according to embodiment 2 of the inventive concept.

Referring to FIG. 3, an X-ray tube 300 according to embodiment 2 of the inventive concept includes an electron beam generation unit 310 emitting an electron beam, a limiting electrode unit 320 limiting the electron beam emitted from the electron beam generation unit 310, and a target unit 330 composed of a target material generating an X-ray by collision with the electron beam having passed the limiting electrode unit 320 and having a limited size.

The foregoing elements are installed in a vacuum container completely sealed or in which an internal vacuum state is continuously maintained by a vacuum pump such that an electron beam may be generated and accelerated in a vacuum environment. The vacuum container may be made of a ceramic or a glass material, such as aluminum oxide, aluminum nitride or glass having an excellent high voltage characteristics and suitable for a vacuum container.

The electron beam generation unit 310 is composed of a cathode connected to a negative terminal of a power source and emitting an electron in the form of an electron beam. Also, the electron beam generation unit 310 may include a focusing unit focusing the electron beam emitted from the cathode such that the electron beam has a constant size, for example a nanometer-scale size. A gate configured to control the amount of the electron beam may be further provided to the electron beam generation unit 310.

The target unit 330 is composed of an anode and is connected to a positive terminal of the power source. The electron beam generated from the electron beam generation unit 310 collides with a metal target of the anode to generate an X-ray.

In embodiment 2 of the inventive concept, the limiting electrode unit 320 is composed of a plurality of slit type electron beam limiting electrodes 321 and 322. The plurality of slit type electron beam limiting electrodes 321 and 322 each may include a slit having a predetermined width.

For example, the plurality of slit type electron beam limiting electrodes 321 and 322 respectively include a plurality of metal electrodes 321*b* and 322*b* spaced by at least one spacer 321*a* and 322*a* having a predetermined thickness. The thickness of the at least one spacer 321*a* and 322*a* determines the slit width, and the slit width may be determined by the size of a focal spot of an X-ray to be generated by the X-ray tube 300. For example, in embodiment 2, the at least one spacer 321*a* and 322*a* may have the thickness of nanometer-scale, and in this case, it is possible that the X-ray tube 300 generates a nano focus X-ray.

In the above, it is described as an example that the plurality of slit type electron beam limiting electrodes 321 and 322 include the at least one spacer 321*a* and 322*a* and an assembly of the plurality of metal electrodes 321*b* and 322*b*, but the inventive concept is not limited thereto. In various embodiments, the plurality of slit type electron beam limiting electrodes 321 and 322 may be manufactured as one element having a slit having a predetermined thickness.

In various embodiments of the inventive concept, the plurality of slit type electron beam limiting electrodes 321 and 322 may be disposed such that slits formed in each of the slit type electron beam limiting electrodes 321 and 322 are aligned at an arbitrary angle with each other. For example, when the X-ray tube 300 is composed of two slit type electron beam limiting electrodes 321 and 322, the two slit type electron beam limiting electrodes 321 and 322 may be disposed such that the slits are aligned to be orthogonal to each other as illustrated in FIG. 3. In various embodiments, the alignment angle of the plurality of slits may be set to an angle at which a current amount of the electron beam 3 arriving at the target unit 330 is measured at a maximum level.

In embodiment 2 of the inventive concept, the electron beam 1 emitted from the electron beam generation unit 310 may have a micrometer-scale diameter. The electron beam 1 emitted from the electron beam generation unit 310 is delivered to the limiting electrode unit 320. In the limiting electrode unit 320, only a portion of the electron beam 3 having passed the slit defined in the plurality of slit type electron beam limiting electrodes 321 and 322 arrives at the target unit 330 while the remaining electron beam is limited by the slit type electron beam limiting electrodes 321 and 322 and is unable to arrive at the target unit 330. In this case, when the slit width is nanometer-scale, the electron beam 3 arriving at the target unit 330 has a nanometer-scale diameter, and consequently, an X-ray 4 having a nanometer-scale focal spot may be emitted from the target unit 330 by collision of the electron beams 3.

In an embodiment described with reference to FIG. 3, a portion of electron beam 2, among the electron beam 1 delivered to the limiting electrode unit 320, having passed through a slit in an x-axis direction defined in a first slit type electron beam limiting electrode 321 arrives at a second slit type electron beam limiting electrode 322. Also, a portion of the electron beam 3, among the electron beams 2 having arrived at the second slit type electron beam limiting electrode 322 and having passed through a slit in a y-axis direction defined in the second slit type electron beam limiting electrode 322 arrives at the target unit 330. As illustrated in FIG. 3, the portion of the electron beams 3 arriving at the target unit 330 after passing through all slits in the x-axis and y-axis directions has a shape having a nanometer-scale diameter.

When an electron beam having high energy is focused during a long time on one position of the target unit 330 in the X-ray tube 300, the target material may be damaged. In order to prevent the target material from being damaged, in various embodiments of the inventive concept, the plurality of slit type electron beam limiting electrodes 321 and 322 may include slits provided in a matrix shape (a grid shape) of a plurality of columns and rows. In this case, the electron beam is selectively deflected and incident into one intersection among a plurality of intersections at which the plurality of columns and rows intersect, and in case that a spot of the target material at which the electron beam passing through the corresponding intersection arrives is damaged, the electron beam is moved to be deflected and incident into another intersection such that the electron beam arrives at a spot of another target material, thereby increasing life time of the target material.

As in embodiment 1, the slit type electron beam limiting electrodes 321 and 322 in embodiment 2 may be made of a material and with a thickness capable of shielding an X-ray generated by the limited remaining electron beam.

In various embodiments of the inventive concept, surfaces defining the slits of the plurality of metal electrodes 321*b* and 322*b*, i.e., surfaces facing to each other, may be machined to be smooth enough to define slits having a nanometer-scale width. Alternatively, spacers 321*a* and 322*a* determining the width of each slit may be precisely manufactured by a thin film forming method or a thick film forming method such as a chemical vapor deposition method or a physical vapor deposition method.

In embodiment 2 of the inventive concept, the electron beam 1 having a micrometer-scale diameter incident into the plurality of slit type electron beam limiting electrodes 321 and 322 should be correctly incident into a location at which the slit is defined. Since an entrance in each of the slit type electron beam limiting electrodes 321 and 322 through which the electron beam 1 passes is very narrow slit type, it may be hard to locate the electron beam 1 correctly on the corresponding location. Also, since the amount of the electron beam 3 passing through the plurality of slits is less than the amount of the incident electron beam 1, the current of the electron beam 3 may not be sufficient to generate an X-ray 4.

To solve such a limitation, in various embodiments of the inventive concept, an electrostatic polarizer having four or more phases may be provided between the plurality of electron beam limiting electrodes 321 and 322 and the electron beam generation unit 310 such that the location in the electron beam limiting electrodes 321 and 322 at which the electron beam emitted from the electron beam generation unit 310 is incident may be finely tuned.

Figure 4:
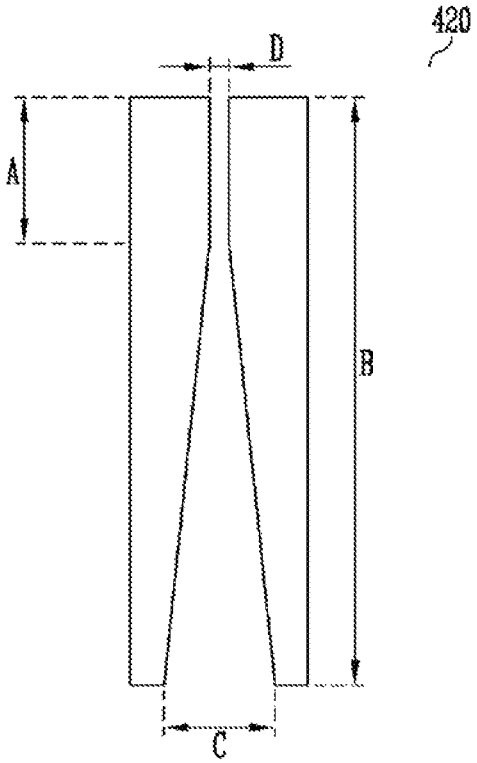
FIG. 4 is a view showing an example of a detailed structure of the slit type electron beam limiting electrode in embodiment 2 of the inventive concept.

Alternatively, in various embodiments of the inventive concept, a slit type electron beam limiting electrode 420 may have a shape illustrated in FIG. 4. More particularly, the slit type electron beam limiting electrode 420 may have a shape in which having a slit width C in an incident surface of the electron beam is greater than a slit width D in an emitting surface of the electron beam. Herein, the slit width D in the emitting surface may be determined by the size of a focal spot of an X-ray to be generated in an X-ray tube, and for example, the slit width D in the emitting surface may be nanometer-scale.

In this case, the total length B of the slit type electron beam limiting electrode 420 in a travelling direction of the electron beam, and the slit length A having the slit width D in the emitting surface may be formed at predetermined values so as to sufficiently shield a limited X-ray.

In an embodiment described with reference to FIG. 4, a portion of the electron beam 1 emitted from the electron beam generation unit 310 may be lost by collision with an inner wall of the slit while travelling from the incident surface to the emitting surface. However, another portion of the electron beam collided with the inner wall of the slit is reflected, and finally passes through the slit. Therefore, the slit type electron beam limiting electrode 420 illustrated in FIG. 4 may enable a greater amount of electron beam to be emitted from the emitting surface than the slit type electron beam limiting electrodes 321 and 322 illustrated in FIG. 3. In this case, it is preferred that the diameter of the electron beam incident into the slit type electron beam limiting electrode 420 of FIG. 4 be formed to be less than the slit width C on the incident surface.

In an embodiment described with reference to FIG. 4, most of electron beam incident with high energy may generate a large amount of heat by collision with the slit type electron beam limiting electrode 420. Since the generated heat may deform a physical shape of the slit type electron beam limiting electrode 420, the slit type electron beam limiting electrode 420 may be disposed outside the vacuum container as a protruding heat dissipation structure such that internal temperature of the X-ray tube 300 is prevented from rising and the heat is discharged to the outside.

When an X-ray is used in semiconductor chip inspection equipment, a material, such as $SiO_2$ used as an insulation film of a semiconductor, is deformed by absorbing an X-ray with low energy of several kV level, thereby causing a damage to the semiconductor chip. Since the low energy X-ray capable of damaging the semiconductor chip is highly scattered and may deteriorate an X-ray image quality in an inspection result, it is preferred to filter the low energy X-ray.

In order to realize the above purpose, in various embodiments of the inventive concept, an X-ray tube may further include a $SiO_2$ filter disposed between a target unit from which an X-ray is emitted and an object. In one embodiment, the $SiO_2$ filter may be provided with the target unit. The $SiO_2$ filter serves to eliminate an unnecessary low energy X-ray. Alternatively, in various embodiments of the inventive concept, the X-ray tube may have a target unit including an anode target formed on a $SiO_2$ substrate. In this case, the $SiO_2$ substrate may serve as an X-ray window while serving as an outer wall of a vacuum container of the X-ray tube.

In various embodiments of the inventive concept, the X-ray tube may further include a donut-shaped electrode between an electron beam generation unit and a limiting electrode unit. In this case, an electron beam emitted from the electron beam generation unit passes through an internal hole of the donut-shaped electrode and arrives at the limiting electrode. The donut-shaped electrode may function to shield a backward retrogression of an X-ray generated by a limited electron beam by the limiting electrode unit.

In embodiments set forth herein, it is described as an example that the target units 230 and 330 are provided as transmission-type targets, but the target units are not limited thereto. Embodiments of the inventive concept may be applicable to a case that the target units 230 and 330 are provided as reflection-type targets.

The present disclosure enables to realize a nano focus X-ray tube with a simple structure without employing a complicated element such as a lens.

While the present invention has been particularly shown and described with reference to exemplary embodiments thereof, it will be understood by those of ordinary skilled in the art that various changes may be made therein without departing from the scope of the present invention as defined by the following claims. Therefore, technical scope of the present invention should not be construed as limited to those described in the description, but determined by the appended claims.

What is claimed is:

1. An X-ray tube comprising:

an electron beam generation unit emitting an electron beam;

a limiting electrode unit limiting the electron beam emitted from the electron beam generation unit; and a target unit comprising a target material emitting an X-ray when the limited electron beam collides with the target material, wherein the limiting electrode unit comprises an electron beam limiting electrode allowing a portion of the emitted electron beam to pass therethrough and to be delivered to the target unit, wherein the portion of the emitted electron beam has a size corresponding to a size of a focal spot of the X-ray.

2. The X-ray tube of claim 1, wherein the limiting electrode unit further comprises a penetration type electron beam limiting electrode having a limiting opening having a predetermined diameter.

3. The X-ray tube of claim 2, wherein the penetration type electron beam limiting electrode delivers, to the target unit, a portion of the electron beam having passed the limiting opening among the emitted electron beams.

4. The X-ray tube of claim 2, wherein the penetration type electron beam limiting electrode is configured to have an equal electric potential as the target unit.

5. The X-ray tube of claim 1, wherein the limiting electrode unit comprises at least one slit type electron beam limiting electrode having a slit having a predetermined width.

6. The X-ray tube of claim 5, wherein the at least one slit type electron beam limiting electrode comprises:

at least one spacer having a thickness corresponding to the predetermined width; and a plurality of metal electrodes spaced by the at least one spacer.

7. The X-ray tube of claim 5, wherein the at least one slit type electron beam limiting electrode is disposed such that slits are aligned with each other at a predetermined angle.

8. The X-ray tube of claim 5, wherein the slit has an incident surface into which the emitted electron beam is incident and an emitting surface through which the portion of the electron beam is delivered to the target unit, and a width of the incident surface is greater than a width of the emitting surface.

9. The X-ray tube of claim 1, wherein the electron beam limiting electrode is made of at least one of tungsten, molybdenum or gold.

10. The X-ray tube of claim 1, further comprising a filter disposed between the target unit and an object to which the X-ray is delivered, the filter being configured to remove a low energy X-ray.

11. The X-ray tube of claim 10, wherein the filter is integrally provided with the target unit.

12. The X-ray tube of claim 1, wherein the electron beam generation unit comprises a cathode emitting the electron beam, and the target unit comprises an anode.

13. The X-ray tube of claim 12, wherein the electron beam generation unit further comprises a focusing unit focusing the electron beam emitted from the cathode in a micrometer-scale.

* * * * *